US010450794B2

(12) United States Patent
Kaiser et al.

(10) Patent No.: US 10,450,794 B2
(45) Date of Patent: Oct. 22, 2019

(54) FLOOR PROTECTOR FOR A GATE

(71) Applicant: Kidco, Inc., Libertyville, IL (US)

(72) Inventors: Daniel Kaiser, Libertyville, IL (US); Zhe Shen, Libertyville, IL (US)

(73) Assignee: Kidco, Inc., Libertyville, IL (US)

( * ) Notice: Subject to any disclaimer, the term of this patent is extended or adjusted under 35 U.S.C. 154(b) by 271 days.

(21) Appl. No.: 15/487,617

(22) Filed: Apr. 14, 2017

(65) Prior Publication Data

US 2018/0298680 A1 Oct. 18, 2018

(51) Int. Cl.
*E06B 7/28* (2006.01)
*E06B 9/02* (2006.01)
*E06B 9/00* (2006.01)

(52) U.S. Cl.
CPC ..... *E06B 9/02* (2013.01); *E06B 7/28* (2013.01); *E06B 2009/002* (2013.01)

(58) Field of Classification Search
CPC ..... E06B 9/02; E06B 7/28; E06B 2009/002
USPC ..... 49/70
See application file for complete search history.

(56) References Cited

U.S. PATENT DOCUMENTS 1,452,703 A * 4/1923 Pollard ..... E06B 7/18 49/482.1
4,443,508 A * 4/1984 Mehl ..... B60J 10/17 16/86 A
4,677,790 A * 7/1987 Adell ..... B60R 13/043 49/462
4,710,992 A * 12/1987 Falwell ..... A47C 27/085 24/545
4,768,320 A * 9/1988 Weller ..... E04G 21/30 52/211
5,048,892 A * 9/1991 Ledbetter ..... A47C 4/54 297/219.1
5,328,156 A * 7/1994 Hoke ..... E04H 17/02 256/1
6,374,545 B1 * 4/2002 Baczuk ..... E06B 7/23 49/470
6,568,149 B2 * 5/2003 Lacasse ..... E06B 3/485 160/232
6,684,572 B2 * 2/2004 Homolka ..... E06B 1/34 49/462
7,476,432 B2 * 1/2009 Pringle ..... B05D 5/061 428/76
8,726,575 B1 * 5/2014 Vulpitta ..... E06B 7/22 49/470
2001/0049909 A1 * 12/2001 Homolka ..... E06B 1/34 49/460
2002/0112444 A1 * 8/2002 Lacasse ..... E06B 3/485 52/784.13
2005/0142371 A1 * 6/2005 Swain ..... B32B 25/08 428/516

(Continued)

*Primary Examiner* — Brent W Herring
(74) *Attorney, Agent, or Firm* — Quarles & Brady, LLP

(57) ABSTRACT

A floor protector for attachment to a gate comprises a base configured to be positioned on a surface to be protected and first and second arms coupled to first and second portions of the base, the first and second arms extending away from the base and biased inwardly toward one another. The first and second arms have a first position in which the first and second arms accommodate a first object having a first dimension and the first and second arms have a second position in which the first and second arms accommodate a second object having a second dimension.

18 Claims, 4 Drawing Sheets

(56) References Cited

U.S. PATENT DOCUMENTS

| | | | | |
|---|---|---|---|---|
| 2005/0155291 | A1* | 7/2005 | Homolka | E06B 1/34<br>49/462 |
| 2005/0252084 | A1* | 11/2005 | Antoshak | E06B 7/23<br>49/70 |
| 2005/0266223 | A1* | 12/2005 | Pringle | B05D 5/061<br>428/295.1 |

* cited by examiner

FLOOR PROTECTOR FOR A GATE

BACKGROUND

Gates and other barriers have been utilized in homes and other areas for years to contain a child or pet within a particular area or prevent a child or pet from entering a particular area. Gates and other barriers may be positioned within a passageway or may include multiple pieces that are linked to one another to create an enclosure.

Many gates for use in obstructing a passageway include a plastic or metal structure that is positioned/installed between, for example, two walls. In some instances, ends of the gate include arms that are positioned adjacent opposing walls and a mechanism within the gate provides a biasing force against the opposing walls to retain the gate in position. In other instances, the gate includes arms that are positioned adjacent the opposing walls and the arms include a mechanism by which the arms can be tightened against the walls to retain the gate in position. Many gates extend from the floor or another surface between the opposing walls. Regardless of the type of gate or the manner in which the gate is installed, the plastic or metal structure of the gate may damage surfaces surrounding the gate (e.g., from movement or pushing on the gate, falling of the gate, etc.).

SUMMARY

Some embodiments provide a floor protector for attachment to a gate, wherein the floor protector comprises a base configured to be positioned on a surface to be protected, first and second arms coupled to first and second portions of the base, the first and second arms extending away from the base and biased inwardly toward one another, and first and second arms coupled to first and second portions of the base, the first and second arms extending away from the base and biased inwardly toward one another, wherein the first and second arms have a first position in which the first and second arms accommodate a first object having a first dimension, wherein the first and second arms have a second position in which the first and second arms accommodate a second object having a second dimension, and wherein the first dimension is greater than the second dimension.

In some embodiments, at least one of the base, the first arm, and the second arm is made of a glow-in-the-dark material. In some embodiments, the first and second arms are integral with the base and the base and first and second arms are made of a flexible material that biases the first and second arms inwardly toward one another. In some embodiments, the base further includes an inner surface configured to, in combination with the first and second arms, accommodate an object, an outer surface opposite the inner surface, and a plurality of ridges extending outwardly from the outer surface, the plurality of ridges configured to be positioned on a surface. In some embodiments, the first and second arms are coupled to first and second ends of the base. In some embodiments, the floor protector is made of silicone. In some embodiments, the floor protector further includes a tab extending outwardly from one of the first and second arms to facilitate insertion and removal of the gate from the floor protector. In some embodiments, Some embodiments provide a floor protector for attachment to a gate, wherein the floor protector comprises a base configured to be positioned on a surface to be protected and first and second arms coupled to first and second portions of the base, the first and second arms extending away from the base and biased inwardly toward one another, wherein the first and second arms are coupled to the base in such a manner that a distance between ends of the first and second arms is variable, wherein a least one of the base, the first arm, and the second arm is made of a glow-in-the-dark material.

In some embodiments, the first and second arms have a first position in which the first and second arms accommodate a first object having a first dimension, the first and second arms have a second position in which the first and second arms accommodate a second object having a second dimension, and wherein the first dimension is greater than the second dimension. In some embodiments, the first and second arms are integral with the base and the base and first and second arms are made of a flexible material that biases the first and second arms inwardly toward one another. In some embodiments, the base further includes an inner surface configured to, in combination with the first and second arms, accommodate an object, an outer surface opposite the inner surface, and a plurality of ridges extending outwardly from the outer surface, the plurality of ridges configured to be positioned on a surface. In some embodiments, the first and second arms are coupled to first and second ends of the base. In some embodiments, the floor protector is made of silicone. In some embodiments, the floor protector further includes a tab extending outwardly from one of the first and second arms to facilitate insertion and removal of the gate from the floor protector.

DETAILED DESCRIPTION

Figure 1:
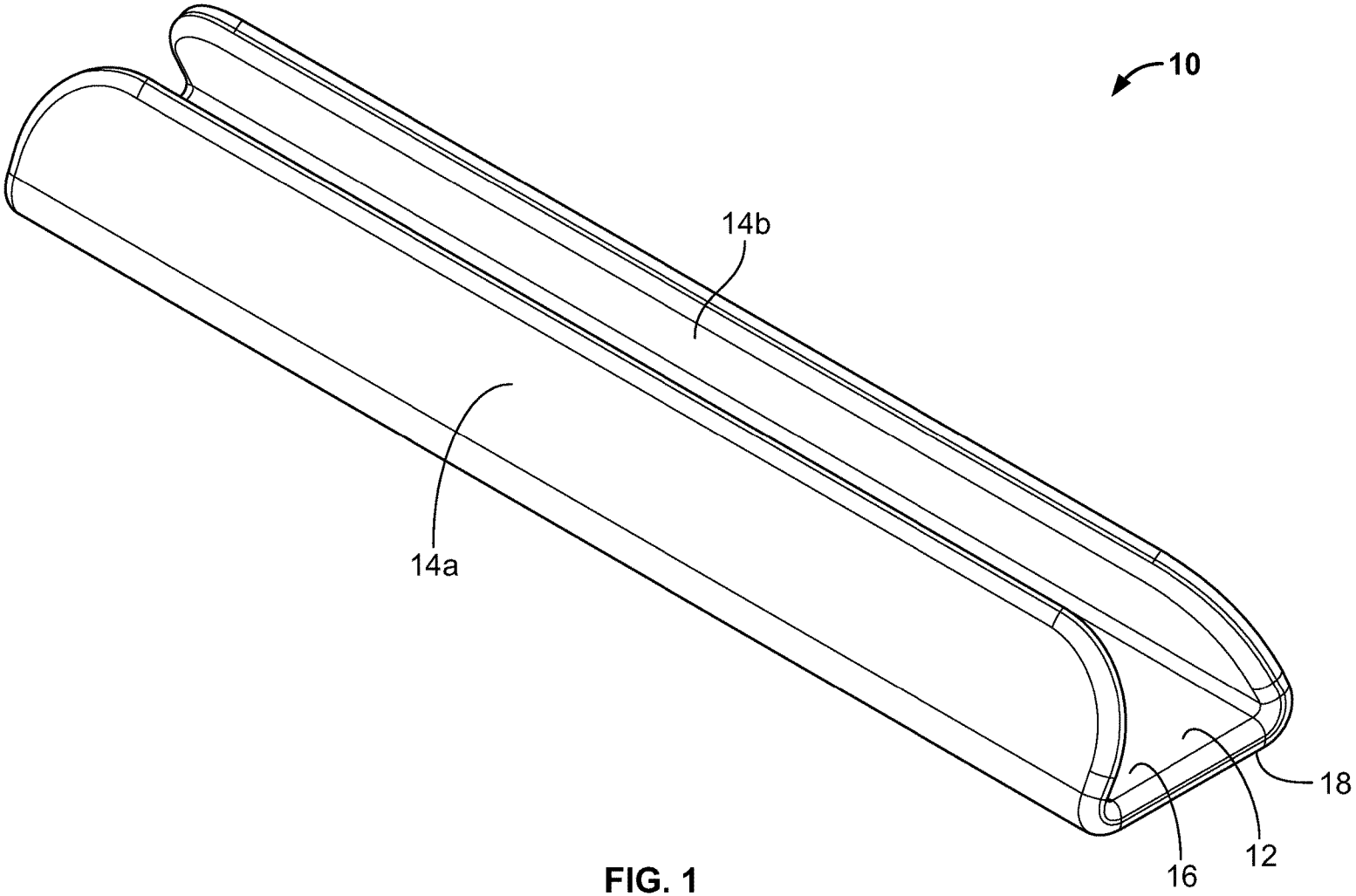
FIG. 1 is a top isometric view of a floor protector for attachment to a bottom surface of a gate or other structure.
Figure 2:
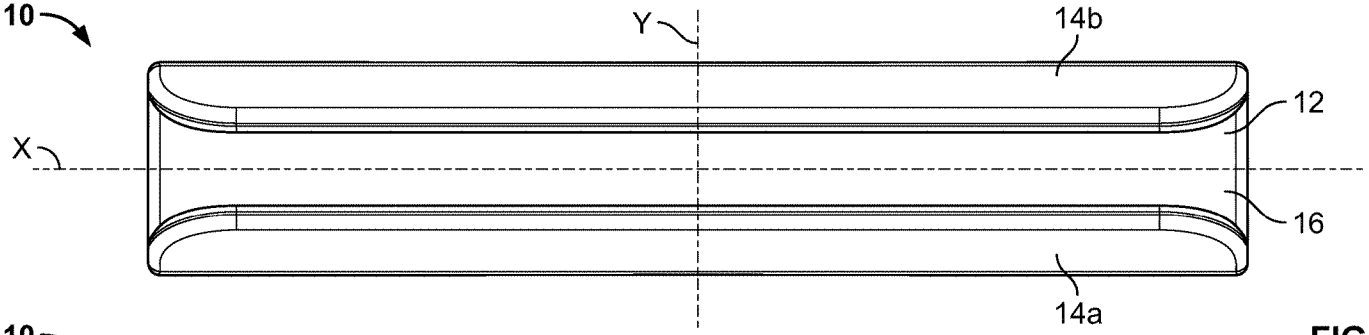
FIG. 2 is a top elevational view of the floor protector of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIGS. 1-5 illustrate a floor protector 10 for use with, for example, a safety gate, according to one embodiment of the invention. Although the floor protector 10 is disclosed herein as being for use with a gate or other barrier, the floor protector may be utilized with numerous different items that may scratch or otherwise damage a surface, for example, a door, a leg of a chair, couch, cabinet, credenza, or other furniture, or any other structure with an elongate tube or other structure, as will be discussed in more detail below.

The floor protector 10 of FIGS. 1-5 generally includes a base 12 and first and second arms 14*a*, 14*b* that extend inwardly from first and second ends 16*a*, 16*b*, respectively, of the arms 14*a*, 14*b*. In illustrative embodiments, the base 12 and arms 14*a*, 14*b* are integral. In other illustrative embodiments, the base 12 and arms 14*a*, 14*b* may be separate components that are attached to one another with the arms 14*a*, 14*b* being biased inwardly toward one another, as will be discussed below. While the arms 14*a*, 14*b* are shown as extending along a full length of the base 12, the arms 14*a*, 14*b* may alternatively extend along only a portion of the base 12 and/or multiple arm portions may form the arms 14*a*, 14*b* (for example, with gaps between each of the arm portions).

Figure 3:
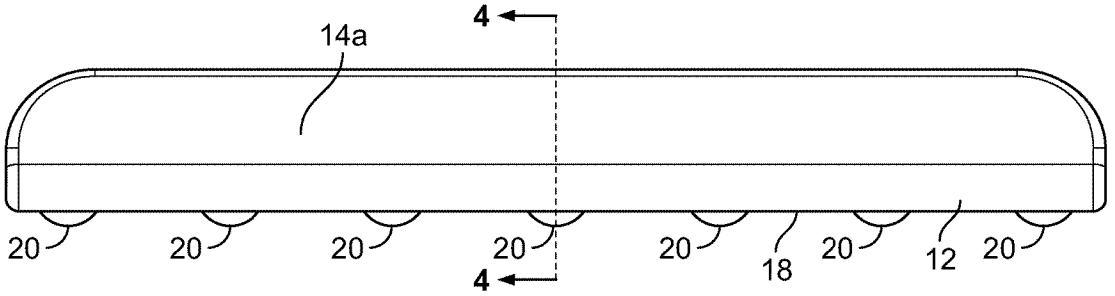
FIG. 3 is a side elevational view of the floor protector of FIG. 1.
Figure 4:
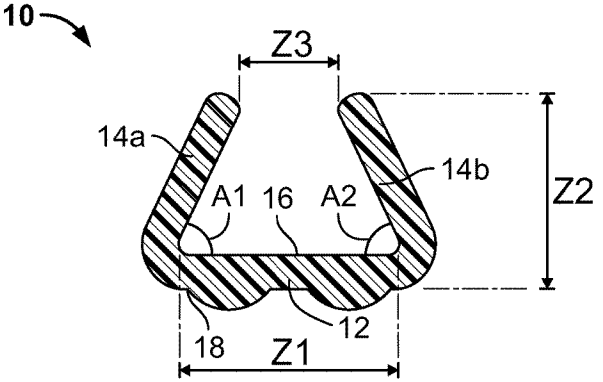
FIG. 4 is a cross-sectional view of the floor protector of FIG. 1 taken generally along the lines 4-4 of FIG. 3.
Figure 5:
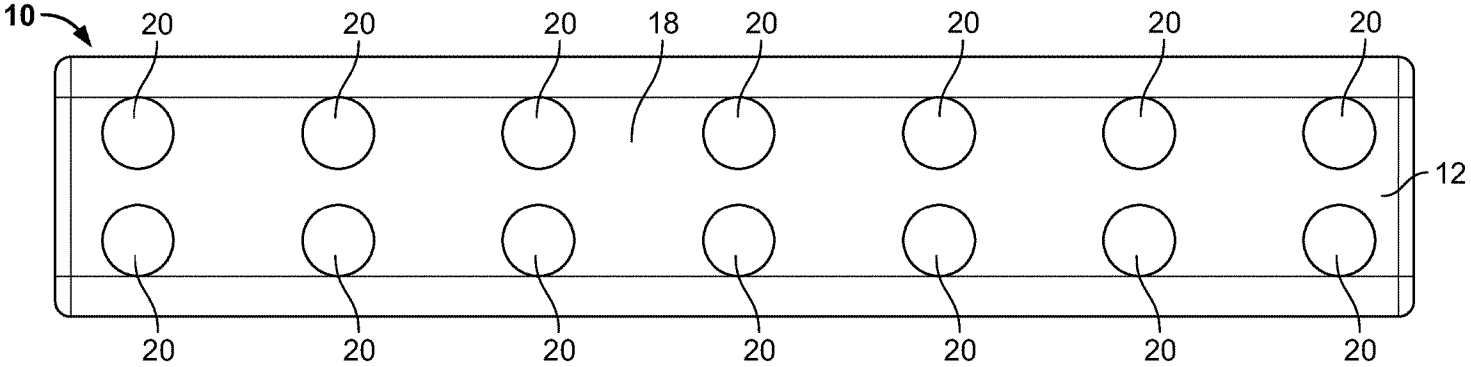
FIG. 5 is a bottom elevational view of the floor protector of FIG. 1.

The base 12 generally includes a first or upper surface 16 and a second or lower surface 18. As indicated in FIG. 4, in an illustrative embodiment, the upper surface 16 may have a width Z1 of about 20 centimeters. In other illustrative embodiments, the upper surface 16 may have any suitable width. As best seen in FIGS. 3-5, a plurality of bumps or ridges 20 may extend outwardly from the lower surface 18 of the base 12. While the ridges 20 are depicted as having a rounded profile, the ridges 20 may take any other suitable form, for example, square-shaped, rectangular, oval-shaped, triangular, or any other suitable shape. Still further, while the ridges 20 are shown as being discrete bumps, the ridges 20 may be formed as elongate ridges, for example, along all or a portion of a length (along a longitudinal axis X) or along all or a portion of a width (along a lateral axis Y) of the base 12 or in a diagonal fashion across all or a portion of the lower surface 18 of the base 12.

Still referring to FIGS. 1-5, each of the arms 14*a*, 14*b* may extend at an angle A1, A2 of between about 45 and about 120 degrees with respect to the base 12. A dimension Z2 between the lower surface 18 of the base 12 and the first and second ends 16*a*, 16*b* of the arms 14*a*, 14*b* may be about 20 centimeters. In other embodiments, the dimension Z2 may be any suitable dimension. As seen in FIG. 4, a dimension Z3 between the first and second ends 16*a*, 16*b* of the arms 14*a*, 14*b* may be about 10 centimeters. In other embodiments, the dimension Z3 may be any suitable dimension. In illustrative embodiments, the dimension Z3 is less than a smallest width of an object to which the floor protector 10 is to be attached, as discussed in greater detail below. The dimensions Z1, Z2, Z3 may be varied based upon sizes of objects with which the floor protector 10 is to be used.

In illustrative embodiments, the floor protector 10 may be made of a flexible material, for example, a thermoplastic material, acetal, acrylic, cellulose acetate, polyethylene, polystyrene, vinyl, nylon, silicone, any other suitable flexible or soft material, and/or combinations thereof. In other illustrative embodiments, the floor protector 10 may be made of any material that would allow the arms to flex, for example, a pliable metal or any other suitable material. In some embodiments, one or more portions of one or more of the base 12, the first arm 14*a*, and the second arm 14*b* may be made of a material that glows-in-the-dark or includes stickers, light-emitting diodes, or other objects that may be adhered or otherwise attached to the floor protector 10 to allow the floor protector 10 to glow-in-the-dark or be illuminated. In this manner, the floor protectors 10 may be visible in the dark, which would allow a person moving about a space including a gate to locate the gate prior to, for example, accidentally walking into the gate.

In illustrative embodiments, the arms 14*a*, 14*b* may be separate from and attached to the base 12, for example, by hinges (not shown). In such embodiments, the hinges may be spring loaded to bias the arms 14*a*, 14*b* inwardly toward one another.

Figure 6:
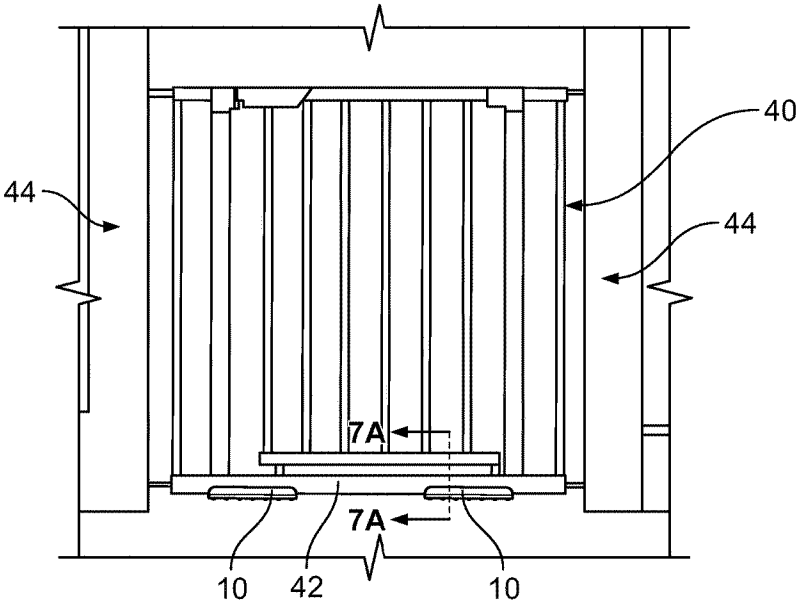
FIG. 6 is a perspective view of two of the floor protectors of FIG. 1 attached to a bottom portion or tube of a gate.

Referring now to FIG. 6, a gate 40 is shown with two floor protectors 10 attached to bottom tubing 42 of the gate 40. In illustrative embodiments, a length of each floor projector 10 may be about 15 centimeters such that the floor protectors 10 may be utilized with objects of varying lengths. In this manner, multiple floor protectors 10 may be utilized along a length or width of an object (e.g., a gate 40 situated between two walls 44), for example, as seen in FIG. 6. In other illustrative embodiments, the floor protector 10 may have any suitable length (for example, to extend along an entirety of an object or only a portion of an object) and/or may be sold in differing lengths and/or may be sold in a longer length and may be cut or otherwise sectioned by a user to form multiple floor protector sections. In yet other embodiments, the floor protector 10 may be modular in that it may be formed of multiple detachable pieces of smaller lengths such that a user can use any number of the detachable pieces to form any number of differently sized floor protectors.

Figures 7A, 7B, 7C:
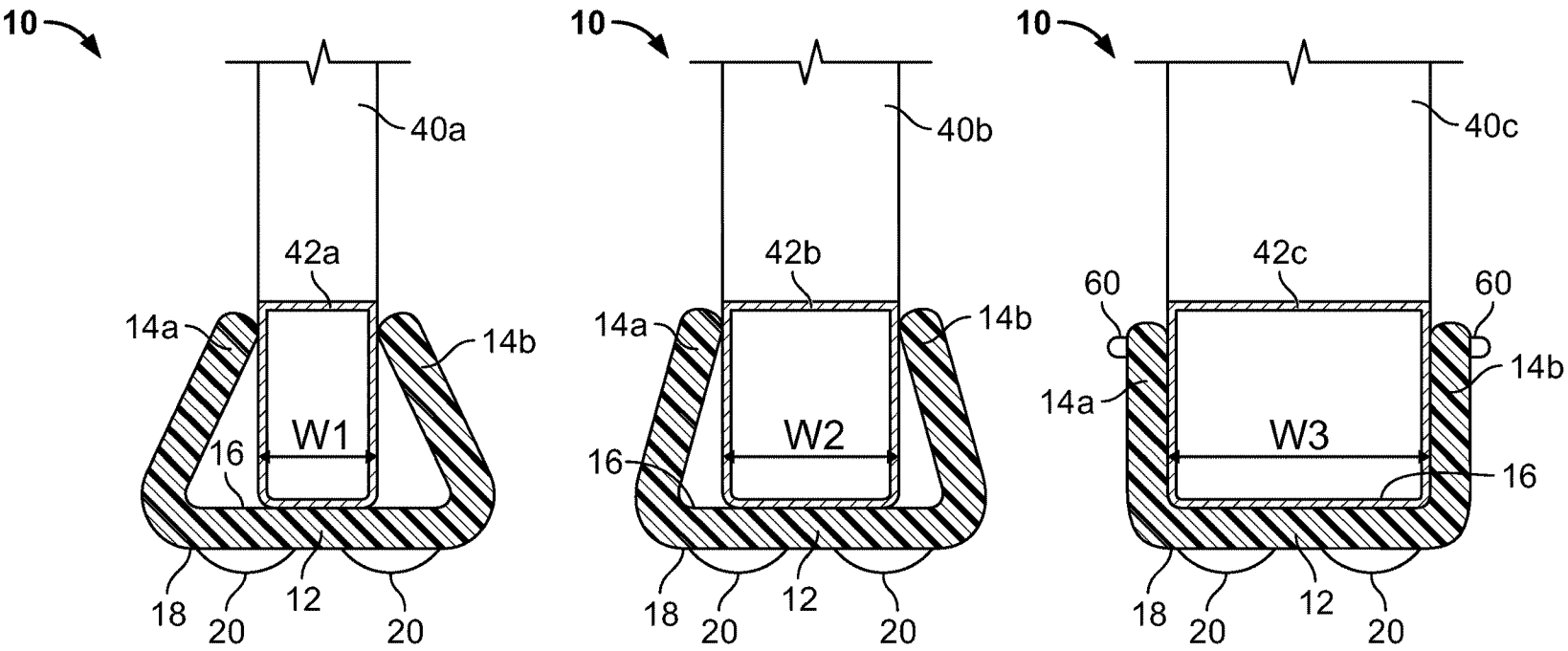
FIGS. 7A-7C are cross-sectional views of the floor protector attached to the gate of FIG. 6 and taken generally along the lines 7A-7A of FIG. 6, the cross-sectional views depicting three different sizes of tubing within the floor protector to illustrate that the floor protector can accommodate tubing or structures of different sizes.

As seen in FIG. 4, the arms 14*a*, 14*b* of the floor protector 10 are biased inwardly toward one another in a non-use position. In use, the arms 14*a*, 14*b* may be pulled outwardly away from one another to accommodate an object (for example, tubing 42 of the gate 40). In some embodiments, tabs 60, as seen in FIG. 7C, may be provided on ends of the arms 14*a*, 14*b* to aid a user in grasping the arms 14*a*, 14*b* for insertion or removal of tubing 42 (or another object). The flexible nature of the arms 14*a*, 14*b* provides a universal floor protector 10 in that the floor protector 10 may be utilized with tubing 42 (or other objects) of different sizes (e.g., widths). Referring to FIGS. 7A-7C, three different sized tubing 42*a*-42*c* of different gates 40*a*-40*c* are depicted with floor protectors 10 attached thereto. The tubing 42*a* has a first width W1, the tubing 42*b* has a second width W2, and the tubing 42*c* has a third width W3, wherein the third width W3 is greater than both the first and second widths W1, W2, and the second width W2 is greater than the first width W1. The floor protector 10 is universal in that it may accommodate objects with sizes, widths, or dimensions between about Z1 and about Z3 centimeters.

Still referring to FIGS. 7A-7C, regardless of the size, width, or dimension of the tubing 40, the floor protector 10 is biased inwardly to grasp tubing of different sizes, widths, or dimensions. More particularly, the arms 14*a*, 14*b* are pulled away from one another a distance that corresponds to a size, width, or dimension of the tubing 42 (or other object) and released once the tubing 42 (or other object) is positioned within the floor protector 10. When released, the bias in the arms 14*a*, 14*b* caused the arms 14*a*, 14*b* to move inwardly, thereby grasping the tubing 42 (or other object) to hold the floor protector 10 on the tubing 42 (or other object).

The floor protectors disclosed herein are designed to protect surfaces on which various different objects rest. In one embodiment, one or more floor protectors may be utilized on a lower portion or tubing of gate to prevent scratching or marring of a floor on which the gate rests. In other embodiments, one or more floor protectors may be attached to a side edge of an object to prevent scratching or marring of a wall or other surface against which the object rests. In some embodiments, the floor protectors are designed to illuminate (or glow-in-the-dark) to reduce the likelihood of a person running into the object in the dark.

While the floor protectors herein are described as being utilized with gates, the floor protectors may optionally be used with any suitable object. Further, while the floor protectors are described as being utilized with an object placed on a surface, such as a floor, the floor protectors may be utilized with an object on any suitable surface, for example, a wall, a ceiling, a countertop, or any other suitable surface.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A floor protector for attachment to a gate, the floor protector comprising:

a base configured to be positioned on a surface to be protected; and first and second arms coupled to the base at first and second radii of curvature, respectively, the first and second arms extending away from the base and biased inwardly toward one another;

wherein the base defines an outer surface and a planar inner surface between the radii of curvature;

wherein the outer surface of the base defines a width between the radii of curvature;

wherein a plurality of ridges extend downwardly from the outer surface at locations spaced inwardly from the radii of curvature;

wherein the plurality of ridges are disposed in at least one row extending along a length of the floor protector perpendicular to the width;

wherein the first and second arms have a first position in which the first and second arms accommodate a first object having a first dimension;

wherein the first and second arms have a second position in which the first and second arms accommodate a second object having a second dimension; and wherein the first dimension is greater than the second dimension.

2. The floor protector of claim 1, wherein at least one of the base, the first arm, and the second arm is made of a glow-in-the-dark material.

3. The floor protector of claim 1, wherein the first and second arms are integral with the base and the base and first and second arms are made of a flexible material that biases the first and second arms inwardly toward one another.

4. The floor protector of claim 1, wherein the first and second arms are coupled to first and second ends of the base.

5. The floor protector of claim 1, wherein the floor protector is made of silicone.

6. The floor protector of claim 1, further including a tab extending outwardly from one of the first and second arms to facilitate insertion and removal of the gate from the floor protector.

7. The floor protector of claim 1, wherein the at least one row is a plurality of rows.

8. The floor protector of claim 1, wherein the plurality of ridges are spherical segments.

9. The floor protector of claim 1, wherein the base defines a first thickness between the inner and outer surfaces, wherein the plurality of ridges define a second thickness parallel to the first thickness, and wherein the first thickness is greater than the second thickness.

10. A floor protector for attachment to a gate, the floor protector comprising:

a base configured to be positioned on a surface to be protected; and first and second arms coupled to the base at first and second radii of curvature, respectively, the first and second arms extending away from the base and biased inwardly toward one another, wherein the base defines an outer surface and a planar inner surface between the radii of curvature;

wherein a plurality of ridges extend downwardly from the outer surface at locations spaced inwardly from the radii of curvature;

wherein the plurality of ridges are spherical segments;

wherein the first and second arms are coupled to the base in such a manner that a distance between ends of the first and second arms is variable;

wherein a least one of the base, the first arm, and the second arm is made of a glow-in-the-dark material.

11. The floor protector of claim 10, wherein the first and second arms have a first position in which the first and second arms accommodate a first object having a first dimension, the first and second arms have a second position in which the first and second arms accommodate a second object having a second dimension, and wherein the first dimension is greater than the second dimension.

12. The floor protector of claim 10, wherein the first and second arms are integral with the base and the base and first and second arms are made of a flexible material that biases the first and second arms inwardly toward one another.

13. The floor protector of claim 10, wherein the first and second arms are coupled to first and second ends of the base.

14. The floor protector of claim 10, wherein the floor protector is made of silicone.

15. The floor protector of claim 10, further including a tab extending outwardly from one of the first and second arms to facilitate insertion and removal of the gate from the floor protector.

16. The floor protector of claim 10, wherein the outer surface of the base defines a width between the radii of curvature, and wherein the plurality of ridges are disposed in at least one row extending along a length of the floor protector perpendicular to the width.

17. The floor protector of claim 10, wherein the outer surface of the base defines a width between the radii of curvature, and wherein the plurality of ridges are disposed in a plurality of rows extending along a length of the floor protector perpendicular to the width.

18. The floor protector of claim 10, wherein the base defines a first thickness between the inner and outer surfaces, wherein the plurality of ridges define a second thickness parallel to the first thickness, and wherein the first thickness is greater than the second thickness.

* * * * *